US005790929A

United States Patent [19]

Goto et al.

[11] Patent Number: 5,790,929

[45] Date of Patent: Aug. 4, 1998

[54] DEVELOPING APPARATUS HAVING MIXING REGION

[75] Inventors: Ryuji Goto, Fukaya; Koji Noguchi, Saitama-ken, both of Japan

[73] Assignee: Hitachi Metals, Ltd., Tokyo, Japan

[21] Appl. No.: 778,919

[22] Filed: Jan. 6, 1997

Related U.S. Application Data

[63] Continuation of Ser. No. 358,996, Dec. 19, 1994, abandoned, which is a continuation of Ser. No. 113,313, Aug. 30, 1993, abandoned, which is a continuation of Ser. No. 888,594, May 27, 1992, abandoned.

[30] Foreign Application Priority Data

May 28, 1991 [JP] Japan ..... 3-123512

[51] Int. Cl.[6] ..... G03G 15/08

[52] U.S. Cl. ..... 399/260; 399/272

[58] Field of Search ..... 399/252, 272, 399/274, 277, 267, 258–260

[56] References Cited

U.S. PATENT DOCUMENTS

| | | | |
|---|---|---|---|
| 4,121,931 | 10/1978 | Nelson | 118/658 X |
| 4,517,274 | 5/1985 | Honda et al. | 430/122 |
| 4,628,019 | 12/1986 | Suematsu et al. | 430/106.6 |
| 4,640,880 | 2/1987 | Kawanishi et al. | 430/106.6 |
| 4,676,192 | 6/1987 | Yuge et al. | 118/658 |
| 4,916,492 | 4/1990 | Hoshika et al. | 355/253 |
| 4,993,829 | 2/1991 | Naganuma et al. | 355/251 |
| 5,003,917 | 4/1991 | Toyoshi et al. | 118/653 |
| 5,188,057 | 2/1993 | Ishikawa et al. | 118/657 |

FOREIGN PATENT DOCUMENTS

| | | | |
|---|---|---|---|
| 0261761 | 11/1986 | Japan | 355/253 |
| 0004282 | 1/1988 | Japan . | |
| 0083753 | 4/1988 | Japan . | |

*Primary Examiner*—Robert Beatty

*Attorney, Agent, or Firm*—Finnegan, Henderson, Farabow, Garrett& Dunnter L.L.P.

[57] ABSTRACT

A developing apparatus including a magnetic conveying means 4 comprising a non-magnetic metal sleeve 7, onto which a developer containing a magnetic toner and a magnetic carrier is attracted, a permanent magnet member 8 having a plurality of magnetic poles and stationary inside the sleeve 7; a casing 1*a* having a developer-containing portion 5 for receiving the magnetic conveying means 4 and a toner-containing portion 3 disposed adjacent to the developer-containing portion 5 for storing the magnetic toner; and a doctor blade 10 for regulating a thickness of the developer 11 on the sleeve 7, the sleeve 7 being rotated such that the magnetic toner is attracted onto a surface of an electrostatic image-bearing member 12, further comprising a downward partition 3*a* and an upward partition 3*b* between the developer-containing portion 5 and the toner-containing portion 3 in such a positional relation that the downward partition 3*a* is closer to the sleeve 7 than the upward partition 3*b*, a developer which has not passed through a gap between the doctor blade 10 and the sleeve 7 being mixed with a freshly supplied magnetic toner in a region R defined by the downward partition 3*a*, the upward partition 3*b*, the sleeve 7 and an inner wall of the casing 1*a*.

1 Claim, 1 Drawing Sheet

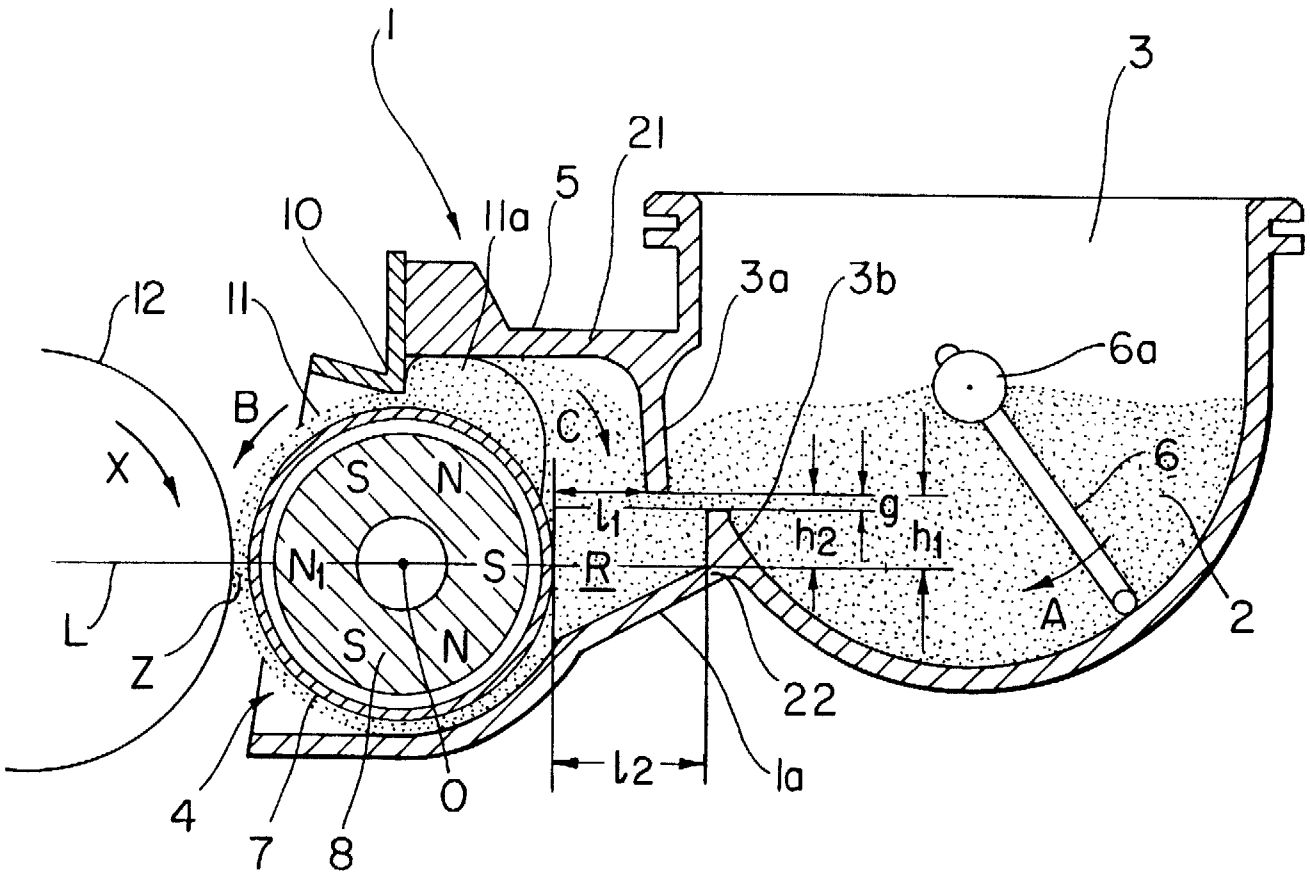
1
3
21
5
11a
10
11
12
B
X
L
Z
4
7
8
O
N
S
N
S
N1
S
C
3a
3b
6a
6
2
A
g
h1
h2
L1
R
L2
22
1a

DEVELOPING APPARATUS HAVING MIXING REGION

This application is a continuation, of application Ser. No. 08/358.996 filed Dec. 19, 1994, now abandoned, which is a continuation of Ser. No. 08/113,313, filed Aug. 30, 1993, now abandoned, which is a continuation of Ser. No. 07/888.594, filed May 27, 1992 now abandoned.

BACKGROUND OF THE INVENTION

The present invention relates to a developing apparatus for use in an electrophotographic method for visualizing an electrostatic latent image formed on an image-bearing member surface with an insulating magnetic toner, more particularly to a developing apparatus for developing an electrostatic image with a developer comprising a magnetic carrier and a magnetic toner which is conveyed to a developing region by the rotation of a sleeve.

In a typical electrophotographic method, an electrostatic latent image formed on a photosensitive drum surface is visualized with colored resin particles called toners, and the resulting toner image is fixed to a transfer sheet such as a sheet of plain paper by a heating means to obtain a fixed image as a hard copy.

Various methods of developing such an electrostatic latent image have been proposed so far. Widely used among them are a two-component method in which a two-component developer consisting of a non-magnetic toner and a magnetic carrier is used, and a one-component method in which only a magnetic toner is used. In conventional methods using such a powder developer, a non-magnetic metal sleeve and a permanent magnet member disposed inside the sleeve are relatively rotated, and a developer attracted onto the non-magnetic metal sleeve is conveyed from inside of the developing apparatus to a developing region, and the unused developer is recovered to the developing apparatus. In general, the conveying speed of such a developer is relatively high in order to obtain a high-quality, or high-density image. This tendency is conspicuous particularly in the case of the one-component developing method. A typical example of such a developing method using an insulating magnetic toner is disclosed in U.S. Pat. No. 4,121,931.

However, since the developer is conveyed at a high speed in the above method, the toner is likely to be scattered outside the developing apparatus. Particularly, in the case of the one-component developing method, since a large force is applied to the toner, the toner particles are likely to be agglomerated.

On the other hand, in the case of the two-component developing method, resin components in the toner particles are likely to be adhered to carrier surfaces, leading to short service life of the carrier. Accordingly, from the viewpoint of reliability, the conveying speed of the developer is preferably set as low as possible, although it should be high to obtain a toner image having a sufficient density.

In the meantime, proposals have recently been made to use as a developer a mixture of a magnetic carrier and a magnetic toner as disclosed by U.S. Pat. Nos. 4,517,274 and 4,640,880. By using such a developer, both advantages of the one-component method and the two-component method can be achieved.

In the above developing method using a mixture of a magnetic carrier and a magnetic toner as a developer, both a metal sleeve and a magnetic roll constituting a developer-conveying means are rotated to obtain a high-quality image. In such a method, a magnetic carrier having a relatively high conductivity is used, and the toner concentration is not particularly controlled to avoid the complicated structure of the developing apparatus. Accordingly, the toner concentration is likely to reach 60 weight % or more in the course of developing operation.

Thus, in the above developing method, the concentration of a toner having a high electric resistance is so high that sufficient triboelectric charging of the toner is not achieved and that the overall resistance of the developer is high. Accordingly, the conveying speed of the developer should be increased to achieve effective development of electrostatic image. As a result, a metal sleeve and a magnetic roll are rotated at high speeds. In such a developing apparatus, the developer is likely to be severely damaged, and high levels of noise tend to be generated in the driving system. Also, such a developing apparatus has a complicated structure.

As a countermeasure for the above problems, it is possible that the developing apparatus has a structure in which the magnetic roll is stationary while only the sleeve is rotated. In this system, a magnetic toner capable of being polarized in only one polarity (positive or negative) is usually used. However, as the amount of magnetic powder in the toner increases, the ability of the toner to retain charges is not sufficiently achieved and the toner is strongly attracted onto the sleeve. This leads to insufficient development of electrostatic images. Therefore, a low-magnetic force toner containing 10–50 weight % of magnetic powder (corresponding to $\sigma s$ of about 8–40 emu/g)has been recently used in many cases.

By rotating only the sleeve and by using a low-magnetic force toner, a good electrostatic image can be developed. It is required under such conditions that the concentration of the toner on the metal sleeve be controlled to 10–50 weight %, preferably 15–40 weight % in a developing region. However, in a conventional developing apparatus using a developer consisting of a magnetic carrier and a magnetic toner (see, for instance, FIG. 5 of U.S. Pat. No. 4,517,274), there is no toner concentration-controlling means. Accordingly, carrier particles are not retained near the metal sleeve, and they are likely to be scattered into the toner container. Thus, it is difficult to control the concentration of the toner properly. Particularly, in a case where development is conducted by rotating only the metal sleeve while making the magnetic roll stationary, the developer is not fully triboelectrically charged, resulting in the difficulty of stably obtaining a good developed image.

OBJECT AND SUMMARY OF THE INVENTION

Accordingly, an object of the present invention is to provide a developing apparatus capable of properly controlling the toner concentration and thus stably producing a good toner image under the condition that a developer is conveyed at a low speed.

To achieve the above object, the present invention provides a developing apparatus comprising a magnetic conveying means comprising a non-magnetic metal sleeve, onto which a developer comprising a magnetic toner and a magnetic carrier is attracted, a permanent magnet member having a plurality of magnetic poles and stationary inside the non-magnetic metal sleeve; a casing having a developer-containing portion for receiving the magnetic conveying means and a toner-containing portion disposed adjacent to the developer-containing portion for storing the magnetic toner; and a doctor member for regulating a thickness of the developer on the sleeve, the non-magnetic metal sleeve being rotated such that the magnetic toner is attracted onto a surface of an electrostatic image-bearing member, further comprising a downward partition and an upward partition between the developer-containing portion and the toner-containing portion in such a positional relation that the downward partition is closer to the non-magnetic metal sleeve than the upward partition, a developer which has not passed through a gap between the doctor blade and the sleeve being mixed with a freshly supplied magnetic toner in a region defined by the downward partition, the upward partition, the sleeve and an inner wall of the casing.

BRIEF DESCRIPTION OF THE DRAWINGS

The FIGURE is a schematic cross-sectional view showing a typical example of the developing apparatus according to the present invention.

DETAILED DESCRIPTION OF THE INVENTION

Referring to the FIGURE, a developing apparatus 1 comprises a casing 1*a* which is constituted by one or more molded plastic parts. The casing l*a* has a toner-containing portion 3 for storing a magnetic toner 2 and a developer-containing portion 5 receiving a magnetic conveying means 4 and adjacent to the toner-containing portion 3. The casing l*a* is provided with a partition 3*a* extending downward from a ceiling (upper inner wall) 21 thereof (referred to as "downward partition") and a partition 3*b* extending upward from a bottom wall (lower inner wall) 22 thereof (referred to as "upward partition") between the toner-containing portion 3 and the developer-containing portion 5. The downward partition 3*a* is located closer to the magnetic conveying means 4 than the upward partition 3*b*.

A means 6 for supplying a magnetic toner 2 into the developer-containing portion 5 is rotatable with a drive shaft 6*a* in the direction shown by the arrow A inside the toner-containing portion 3. The toner supply means 6 may be formed by, for instance, a small-diameter rod or blade bent in a U shape.

The magnetic conveying means 4 is constituted by a rotatable hollow cylindrical sleeve 7 made of a non-magnetic metal such as stainless steel, etc. and a magnetic roll 8 made of a permanent magnet material and stationarily disposed inside the sleeve 7 concentrically.

The magnetic roll 8 has a plurality of magnetic poles, among which a particular N pole (labeled as $N_1$, in the FIGURE) may be located at such a stationary position that it always faces an electrostatic image-bearing member 12 with a gap of, for instance, 0.2–0.6 mm. The sleeve 7 is rotatable about an axis O in the direction shown by the arrow B.

The casing l*a* of the developing apparatus 1 is provided with a doctor blade 10 on an outlet side such that a tip end of the doctor blade 10 is positioned close to an upper surface portion of the sleeve 7 with a gap of, for instance, 0.2–0.6 mm, thereby regulating a thickness of the developer 11 supplied into a developing region Z defined between the image-bearing member 12 and the non-magnetic sleeve 7. The developer 11 passing through the gap between the doctor blade 10 and the sleeve 7 forms a magnetic brush in the developing region Z. After development of the electrostatic image on the electrostatic image-bearing member (photosensitive drum) 12, the developer 11 becomes carrier-rich due to the consumption of the magnetic toner, and returns to the developer-containing portion 5.

The image-bearing member 12 rotates in a direction shown by the arrow X and is provided with an electrostatic latent image (not shown) by charging and exposure on the surface.

In the developing apparatus having the above structure, a predetermined amount of a magnetic carrier is supplied onto the magnetic conveying means 4 while rotating the sleeve 7 in the direction B, so that the magnetic carrier is attracted as a thin layer onto the sleeve 7. Since the magnetic carrier on the sleeve 7 is regulated by the doctor blade 10 with respect to its thickness, a magnetic carrier reservoir 11*a* is formed on the upstream side of the doctor blade 10 with respect to the rotation of the sleeve 7.

Next, the magnetic toner 2 is supplied into the toner-containing portion 3 by a toner cartridge (not shown). By operating the toner supply means 6, the magnetic toner 2 is conveyed from the toner-containing portion 3 to the developer-containing portion 5, passing through the upward partition 3*b* and the downward partition 3*a*. The magnetic toner 2 supplied into the developer-containing portion 5 is mixed with the magnetic carrier to form a developer 11 due to the rotation of the sleeve 7 in the developer-containing portion 5 including the developer reservoir region 11*a*.

Since the concentration of the magnetic toner 2 in the developer 11 is determined by the amount of the magnetic carrier supplied into the developer-containing portion 5 and the amount of the magnetic toner 2 supplied from toner-containing portion 3 into the developer-containing portion 5, it is possible to control the toner concentration to 10–50 weight %, preferably 15–40 weight % by adjusting the amount of the magnetic carrier.

The downward partition 3*a* extending from the ceiling of the casing 1*a*and the upward partition 3*b* extending from the bottom wall of the casing 1*a* have an important function to form a region for controlling the toner concentration. In the developer-containing portion 5, the magnetic toner and the magnetic carrier are mixed by the rotation of the sleeve 7. In this case, a first portion of the developer consisting of the magnetic carrier and the magnetic toner does not pass through the gap between the doctor blade 10 and the sleeve 7 and resides in an upstream region (developer reservoir region 11*a*) on the sleeve 7. A second portion of the developer passes through this gap. Magnetic toner 2 then falls along the downward partition 3*a* as shown by the arrow C. By means of the upward partition 3*b* extending from the bottom wall of the casing 1*a*, this portion of the magnetic toner 2 is kept in a region R of the developer-containing portion 5 defined by the downward partition 3*a*, the upward partition 3*b*, the sleeve 7 and the inner wall of the casing 1*a*. Accordingly, in this region R, the residing magnetic toner is mixed with the magnetic toner freshly supplied from the toner-containing portion 3. Also, as shown in FIG. 1, magnetic toner only partially fills region R.

In the FIGURE, downward projection 3*a* terminates at a distance $h_1$ from a reference plane L passing through the axis of rotation O while upward projection 3*b* extends a distance $h_2$, creating a positive gap g ($=h_1_h_2$) in the horizontal direction along L.

The dimension ($l_1$, $l_2$, $h_1$, $h_2$) of each portion in the region R can be determined depending on the shapes of the casing l*a*, etc. as long as the partitions 3*a*, 3*b* can conduct the above-described functions. Namely, provided that the downward partition 3*a* can guide the developer in the direction C and that the upward partition 3*b* can lead the magnetic toner into the region R while preventing the carrier near the sleeve 7 from flowing into the toner-containing portion 3, the partitions 3*a*, 3*b* may be in any shape and dimension other than those depicted in the FIGURE. For instance, as long as the above conditions are met, the top end of the upward partition 3*b* may be higher than the lower end of the downward partition 3*a*($h_2>h_1$) creating a "negative" gap g (not shown).

By the above structure, a predetermined amount of the magnetic carrier is kept in the region R in the developer-containing portion 5, and an excess amount of the magnetic toner is not supplied from the toner-containing portion 3 into the developer-containing portion 5. Thus, the weight ratio of the magnetic toner to the magnetic carrier is kept constant in the developer-containing portion 5. Accordingly, the toner concentration in the developer 11 on the sleeve 7 in the developing region Z is kept at a substantially constant level. Further, by selecting the amount of the magnetic carrier supplied into the developer-containing portion 5 to a proper level, the toner concentration can be controlled at a desired level.

The magnetic carrier usable in the present invention is produced from iron powder, iron oxide (for instance, magnetite), soft ferrite (for instance, Ni—Zn ferrite, Mn—Zn ferrite, Cu—Zn ferrite), such magnetic powder bonded with resin binders, etc. Among these materials, the ferrite carrier is particularly suitable because it is chemically stable, suffers from little change of electric resistivity and has a smaller apparent density.

By evaluating the properties of the magnetic carrier, it has been found that not only its electric and magnetic properties but also its particle size largely affect the image quality. In the present invention, the magnetic carrier of course has a particle size larger than that of the toner. It is necessary that most of the magnetic carrier is within the range of 20–105 μm. Those less than 20μm or exceeding 105μm are preferably less than 5% by weight. When the carrier particles less than 20μm are 5% or more, the magnetic carrier is likely to attach to the surface of the image-bearing member. On the other hand, when those exceeding 105 μm are 5% or more, the surface of the photosensitive drum tends to be damaged. The preferred particle size range of the magnetic carrier is 37–74 μm. Incidentally, an average particle size of the magnetic carrier according to the present invention is more preferably 50–70 μm.

With respect to the other properties, a saturation magnetization ($\sigma_s$) and an electric resistivity are important. In the present invention, the saturation magnetization is desirably 30–80 emu/g. When it is smaller than 30 emu/g, the magnetic carrier is likely to attach to the surface of the photosensitive drum, and when it exceeds 80 emu/g, the developability becomes poor. The more preferred saturation magnetization of the magnetic carrier is 55–75 emu/g. The electric resistivity of the magnetic carrier is preferably $10^5$–$10^{10}$ Ω·cm (measured in a DC electric field of 200 V/cm). When it is too large, electric charge is likely to be stored in the magnetic carrier, resulting in poor development. On the other hand, when it is too low, breakdown easily takes place at a low voltage. The more preferred electric resistivity of the magnetic carrier is $10^7$–$10^9$Ω·cm.

With respect to the magnetic toner, it consists of toner particles comprising a binder resin and magnetic powder. The binder resin is selected depending upon the fixing method. For instance, in the case of a heat-fixing method, styrene resins, polyester resins, epoxy resins or these mixtures are preferable. The magnetic powder may be ferromagnetic metals such as iron, cobalt, nickel, etc. or their alloys or compounds containing these elements such as magnetite, etc. From the aspect of color and magnetic properties, magnetite is suitable. The amount of the magnetic powder is preferably 50 weight % or less. When the amount of the magnetic powder is too large, the toner cannot keep its electric charge and is less attracted onto the sleeve, so that it is difficult for the magnetic toner to have a chargeability in a particular polarity. Incidentally, when the amount of the magnetic powder is too small, the magnetic toner is likely to be scattered. Accordingly, the lower limit of the magnetic powder is preferably 10% or more. In this case, it is preferable that the magnetic toner has a saturation magnetization of about 8–41 emu/g when a usual magnetite is used.

In the present invention, in addition to the above indispensable components, the magnetic toner desirably contains a charge-controlling agents such as nigrosine dies or azo dies containing metals, etc. for having a large chargeability in a particular polarity. Further, fluidity improvers (such as silica, alumina, etc.) and resistance-adjusting agents (such as carbon black, etc.) may be added.

The magnetic toner usable in the present invention can be prepared by known methods such as a pulverization method, a spray-drying method, or a polymerization method. The preferred properties of the magnetic toner used in the present invention are as follows. The particle size distribution is within the range of 5 –20 μm, preferably 6–16 μm. Incidentally, when there are a lot of toner particles having a particle size of 8 μm or less, the fogging tends to be generated. Accordingly, toner particles having a particle size of 8 μm or less are preferably 20 weight % or less based on the total weight of the magnetic toner. The specific resistivity of the magnetic toner is $10^{14}$Ω·cm or more (measured in a DC electric field of 4 kV/cm) from the aspect of transferability.

The developer of the present invention is prepared from the above magnetic carrier and magnetic toner. The amount of the magnetic toner in the developer (toner concentration) is changeable as widely as 10–90% by weight, but the preferred toner concentration is 10–50 weight %, and more particularly 15–40 weight % for the purpose of the present invention. The amount of the magnetic carrier may vary depending upon the materials of the carrier and the size of the developing apparatus. In the case of the ferrite carrier, its amount is preferably 0.05–1 g/cm$^2$ per a unit area of the sleeve.

Apart from the above conditions, the desired development conditions for carrying out the present invention are as follows: With respect to the surface potential of the photosensitive materials used, which may vary depending upon the types of the photosensitive materials used, it is preferably 400–700 V in an absolute value. Also, in the case of the reverse development of the electrostatic latent image on the organic photosensitive drum, a bias voltage 0.6–0.9 times as large as the surface potential in the same polarity is applied to the sleeve to obtain a high-density image without fogging. With a development gap of 0.2–0.6 mm, good contact between the magnetic brush and the photosensitive drum can be obtained. The doctor gap may be the same or slightly smaller than the developing gap.

Incidentally, in the present invention, the magnetic properties of the magnetic carrier and the magnetic toner are measured in a magnetic field (maximum: 10 kOe) by a vibrating sample magnetometer (Model VSM-3, manufactured by Toei Industry Co., Ltd.).

EXAMPLE 1, COMPARATIVE EXAMPLE 1

58 parts by weight of a styrene-n-butyl methacrylate copolymer (Mw: about 200,000, Mn: about 10,000), 40 parts by weight of magnetite (EPT-500, manufactured by Toda Kogyo Corporation) and 2 parts by weight of a Crcontaining azo die (BONTRON E81 manufactured by Orient Chemical Industries, Ltd.) were dry-mixed and melt-blended. After cooling and solidifying, the resulting blend was pulverized and classified to obtain magnetic toner having an average particle size of 10 Ωm and a blow-off triboelectric charge of −10 μc/g. This magnetic toner was mixed with ferrite carrier having an electric resistivity of $10^8$Ω·cm and a particle size of 37–105 μm (KBN-100 manufactured by Hitachi Metals, Ltd.) to prepare a developer.

With the above developer, an image was produced under the following conditions. In the FIGURE, the image-bearing member 12 was an organic photosensitive drum (polarity: negative, outer diameter: 40 mm), and this drum was rotated at a peripheral speed of 50 mm/sec. The sleeve 7 was produced from a SUS304 cylinder having an outer diameter of 20 mm, and a cylindrical magnet having 6 non-symmetric magnetic poles ($N_1$=750 G) was fixed to a shaft inside the sleeve 8. The sleeve was rotated at a peripheral speed of 165 mm/sec. The developing gap and the doctor gap were 0.32 mm and 0.27 mm, respectively. $l_1$ and $l_2$ were 10 mm and 15 mm, respectively, and $h_1$ and $h_2$ were 5 mm and 4 mm, respectively.

The photosensitive drum was charged such that its surface potential (charged portion) was −550V and its residual potential (exposed portion) was −50V, and a DC bias voltage of −400V was applied to the sleeve 8 to carry out reverse development. Next, the developed toner image was transferred to a plain paper, and fixed by a heat roller (fixing temperature: 180° C., fixing pressure: 1 kg/cm, nip width: 4 mm).

In the above operation, with various amounts of magnetic carrier in the developer-containing portion, the resulting images were evaluated. The results are shown in Table 1.

TABLE 1

| Sample No. | Amount of Carrier (g) | Toner Concentration* on Sleeve | Image Density | Resolution | Adhesion to Carrier |
|---|---|---|---|---|---|
| 1 | 10 | 58 | 1.34 | poor | excellent |
| 2 | 22 | 40 | 1.39 | good | excellent |
| 3 | 30 | 33 | 1.41 | excellent | excellent |
| 4 | 40 | 21 | 1.44 | excellent | excellent |
| 5 | 50 | 15 | 1.43 | excellent | excellent |
| 6 | 60 | 10 | 1.38 | excellent | slightly poor |

Note: *Weight %.

It is clear from the results shown in Table 1 that when the toner concentration exceeds 50 weight % (Sample No. 1) the image resolution decreases in the developing apparatus of the present invention, and that when the toner concentration reaches 10 weight % (Sample No. 6), the magnetic toner is likely to be adhered to the magnetic carrier. Also, in the toner concentration of 15–40 weight % (Sample Nos. 2–5), image having extremely high quality can be obtained.

As Comparative Example 1, the same test was conducted except for using a developing apparatus having no downward partition and no upward partition (conventional developing apparatus). In this case, the toner concentration became 60 weight % or more in a continuous copying operation even though the initial toner concentration was set at 50 weight %. On the other hand, in the case of using the developing apparatus shown in the FIGURE, it has been confirmed the toner concentration never exceeds substantially 50 weight %.

As described above in detail, according to the present invention, since the developer can be conveyed only by the rotation of the sleeve at a relatively low speed, the structure of the developing apparatus is rather simple, and the toner concentration on the sleeve can be controlled at a low level in a developing region, thereby achieving sufficient triboelectric charging and low electric resistance of the developer. Thus, even with a relatively low sleeve rotation speed, high-quality image without fogging, etc. can be obtained at a high density for a long period of time. In addition, the developing apparatus according to the present invention enjoys sufficiently reduced levels of noise.

What is claimed is:

1. A method for developing an electrostatic latent image on an electrostatic image-bearing member using an apparatus including a magnetic conveying means including a rotatable non-magnetic metal sleeve and a permanent magnet member having a plurality of magnetic poles and mounted to be stationary inside the non-magnetic metal sleeve; a casing having a portion for containing a developer including a carrier and a magnetic toner, and for receiving the magnetic conveying means in a position to define a developing region having a gap of 0.2–0.6 mm between said sleeve and an electrostatic image-bearing member having an organic photosensitive surface, said photosensitive surface having a surface potential of 400–700 V in absolute value, the casing also having a toner-containing portion disposed adjacent to the developer-containing portion for storing fresh magnetic toner and with a toner supply means positioned in the toner containing portion; and a doctor blade defining a gap of 0.2–0.6 mm with the sleeve for regulating a thickness of the developer on the sleeve carried to the developing region, said magnetic poles being positioned so as to form on said sleeve at the upstream side of said doctor blade a developer reservoir comprising a first portion of the developer which has not passed through said gap between said doctor blade and said sleeve, and the casing further comprising a downward partition extending vertically from an upper inner wall and an upward partition extending vertically from a lower inner wall, said downward partition and said upward partition disposed between the developer-containing portion and the toner-containing portion in such a positional relation that the downward partition is closer to the non-magnetic metal sleeve than the upward partition and a lower end of the downward partition is positioned above an upper end of the upward partition, said upper inner wall extending horizontally from the doctor blade to the toner-containing portion, a circulating region being defined by the doctor blade, the sleeve, the downward partition and the upper inner wall, a developer mixing region being defined by the downward partition, the upward partition, the sleeve and a lower inner wall of said casing, the method comprising the steps of:

providing to the toner-containing portion fresh magnetic toner containing 10–50 weight % of magnetite having a saturation magnetization of 8–41 emu/g and capable of being polarized in only one polarity;

providing to the developer-containing portion magnetic carrier in an amount for controlling the concentration of the magnetic toner to 15–40 weight % in the developer amount carried to the developing region;

rotating the non-magnetic metal sleeve such that the developer reservoir is formed by the first portion of the developer which has not passed through said gap between said doctor blade and said sleeve at the upstream side of said doctor blade, and such that magnetic toner in a second portion of the developer carried past the doctor blade is attracted onto the surface of the electrostatic image-bearing member;

allowing toner from the first portion of the developer to fall in the direction opposite the rotation direction of said non-magnetic metal sleeve along said downward partition through the circulating region into said developer mixing region, said toner from the first portion of the developer only partially filling the circulating region; and mixing in the mixing region fresh toner supplied from the toner-containing portion and the toner from the first portion of the developer.

* * * * *